US011622215B2

(12) United States Patent
Kuipers et al.

(10) Patent No.: US 11,622,215 B2
(45) Date of Patent: Apr. 4, 2023

(54) HEARING DEVICE ASSEMBLIES

(71) Applicant: Sonova AG, Staefa (CH)

(72) Inventors: Erwin Kuipers, Wolfhausen (CH); Grace Gardner, San Leandro, CA (US)

(73) Assignee: Sonova AG, Staefa (CH)

( * ) Notice: Subject to any disclaimer, the term of this patent is extended or adjusted under 35 U.S.C. 154(b) by 180 days.

(21) Appl. No.: 16/713,330

(22) Filed: Dec. 13, 2019

(65) Prior Publication Data

US 2021/0185463 A1 Jun. 17, 2021

(51) Int. Cl.
*H04R 25/00* (2006.01)

(52) U.S. Cl.
CPC ..... *H04R 25/658* (2013.01); *H04R 25/652* (2013.01); *H04R 25/70* (2013.01)

(58) Field of Classification Search
CPC H04R 25/656; H04R 2225/025; H04R 25/60; H04R 2225/021
USPC ..... 381/312, 322, 328, 330
See application file for complete search history.

(56) References Cited

U.S. PATENT DOCUMENTS 5,395,168 A 3/1995 Leenen
8,331,593 B2 12/2012 Slemming
8,792,663 B2 7/2014 Cano
8,855,347 B2 10/2014 Aubert
9,319,809 B2 4/2016 Sohn
2009/0052710 A1* 2/2009 Smith ..... H04R 25/656 381/328
2009/0141920 A1* 6/2009 Suyama ..... H04R 25/658 381/328
2011/0188689 A1* 8/2011 Beck ..... H04R 25/609 381/328
2011/0274296 A1* 11/2011 Wai ..... H04R 1/1016 381/121
2014/0224283 A1* 8/2014 Smith ..... H04R 25/654 381/328
2015/0289061 A1* 10/2015 Rasmussen ..... H04R 25/02 381/328

OTHER PUBLICATIONS

Decibullz, et al., Custom Molded Earplugs, Decibullz Custom Molded Earplugs webpage as saved Jun. 28, 2019.

* cited by examiner

*Primary Examiner* — George C Monikang
(74) *Attorney, Agent, or Firm* — ALG Intellectual Property, LLC

(57) ABSTRACT

An exemplary hearing device assembly is configured to be worn at least partially within an ear canal of a user. The hearing device assembly includes a housing including an output transducer configured to provide an output audio signal representative of sound presented to the user. The housing is configured to be positioned entirely within the ear canal. The hearing device assembly also includes a tube extending from an end of the housing and configured to provide an acoustic pathway from outside the ear canal to the housing, an inner seal extending from the housing, and an outer seal extending from the tube. The inner seal and the outer seal are together are configured to enclose a main volume that surrounds the tube within the ear canal and that is acoustically sealed from an ambient environment of the user.

20 Claims, 12 Drawing Sheets

HEARING DEVICE ASSEMBLIES

BACKGROUND INFORMATION

Hearing devices that are configured to fit in an ear canal of a user may cause an occlusion effect. The hearing device may block the ear canal of the user, causing the user's voice to reflect back into the ear. The occlusion effect may cause the user to hear the user's own voice differently than the user may be accustomed to hearing. Conventional hearing devices often include a vent to alleviate the occlusion effect. However, a vent may not entirely eliminate the occlusion effect. Further, a vent may introduce comb filter effects at low gains, lower speech intelligibility in noisy environments, as well as other drawbacks. Additionally, conventional hearing devices have a variety of other drawbacks, such as mismatched acoustic coupling, loss of a natural hearing experience due to the placement of the hearing device microphones, and high visibility of the hearing devices.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
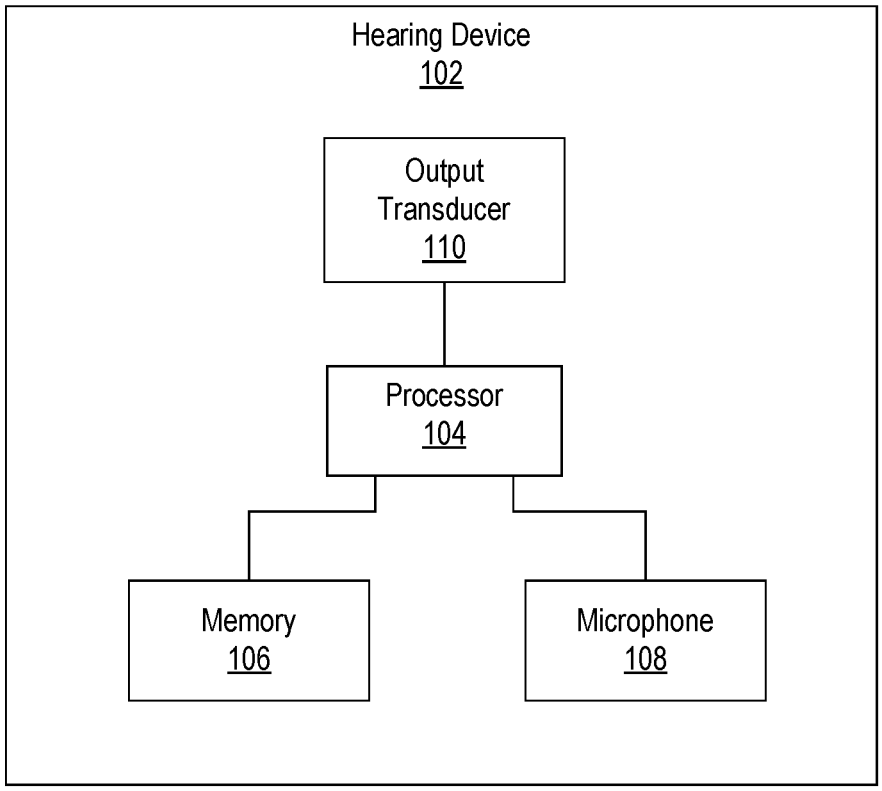
FIG. 1 shows an exemplary configuration of a hearing device according to principles described herein.

Exemplary hearing device assemblies configured to be worn at least partially within an ear canal of a user are described herein. For example, a hearing device assembly may comprise a housing including an output transducer configured to provide an output audio signal representative of sound presented to the user, the housing configured to be positioned entirely within the ear canal, a tube extending from an end of the housing and configured to provide an acoustic pathway from outside the ear canal to the housing, an inner seal extending from the housing, and an outer seal extending from the tube. The inner seal and the outer seal may be together configured to enclose a main volume that surrounds the tube within the ear canal and that is acoustically sealed from an ambient environment of the user.

The hearing device assemblies described herein may advantageously provide many benefits to users of hearing devices. For example, by enclosing a main volume that surrounds a tube providing an acoustic pathway from outside the ear canal to the housing, the hearing device assemblies described herein may prevent a user's own voice from being picked up by the user's eardrum, Moreover, the hearing device assemblies described herein may acoustically seal the microphone from picking up the user's voice from the ear canal. Thus, the hearing device assemblies described herein may minimize or eliminate an occlusion effect for the user. The acoustically sealed microphone may also allow the hearing device assembly to have a high feedback stability threshold.

Further, as the microphone may be included in the housing that is configured to be positioned entirely within the ear canal (and closer to an ear drum of the user), the hearing device assemblies described herein may provide a more natural sounding audio signal than hearing devices with microphones outside the ear canal. Beamforming may also be optimally directed, as the microphone is positioned inside the ear canal. Additionally, the microphone included in the housing positioned within the ear canal may also improve acoustic coupling compared to the microphone being positioned outside the ear canal or further away from the eardrum. Moreover, as the housing is positioned deep in the ear canal, visibility of the hearing device may be minimized. For at least these reasons, the hearing device assemblies described herein may advantageously increase performance, reliability, and ease of use for hearing device users compared to conventional hearing device assemblies. These and other benefits of the hearing device assemblies described herein will be made apparent herein.

In some implementations, the inner seal is configured to create a residual ear canal volume between an eardrum of the user and a surface formed by the inner seal and the housing. The inner seal may be implemented by one or more retention rings that extend radially from the housing to a wall of the ear canal. In some implementations, the housing further includes a microphone configured to detect an input audio signal, wherein the output audio signal is based on the input audio signal. The hearing device assembly can include a second microphone configured to detect a voice of the user. The second microphone can comprise an acoustic transducer configured to transduce the detected voice to an electrical signal. The second microphone may be included in the housing.

The outer seal may be implemented by one or more retention rings that extend radially from a lateral end of the tube to a wall of the ear canal. The outer seal may also be implemented by one or more retention members that extend out of the ear canal and into a concha of the user, the one or more retention members configured to fit in the concha of the user. In some implementations, the one or more retention members are configured to fit in the concha of the user by being individually fitted to a shape of the concha. The individual fitting may comprise the one or more retention members being thermo-formed into an individual shape of the concha and/or being three dimensionally printed according to an individual shape of the concha. In some implementations, the tube is individually fitted into at least one of a shape and a length of the ear canal. The individual fitting may comprise the tube being thermo-formed and/or three dimensionally printed. The one or more retention members and/or tube can thus be custom made according to user specific requirements.

In some implementations, a length of the tube and/or a length of the lateral seal is fitted individually to guarantee an optimized acoustic sealing inside and/or outside the ear canal, in particular at a lateral side of the ear, and/or to avoid the housing and/or the inner seal touching an eardrum inside the ear canal. The length fitting may be performed by a trained person, for instance a hearing care professional. The ear canal may be examined for a suitability of the fitting of the hearing device assembly prior to the fitting.

In some implementations, the outer seal is configured to hold one or more additional components of the hearing device assembly. For instance, the one or more additional components may be included in the outer seal and/or included in an external structure mechanically coupled to the outer seal. The one or more additional components may include at least one of a power supply, a processor, a communication interface, an inertial sensor, a biometric sensor, and an antenna. The biometric sensor may comprise at least one of an optical sensor configured to detect light, for instance a photoplethysmography (PPG) sensor, an electrode configured to detect voltage fluctuations, for instance an electroencephalogram (EEG) and/or electrocardiogram (ECG) and/or electrooculogram (EOG) sensor, and a temperature sensor. The inertial sensor may comprise at least one of an accelerometer and a gyroscope.

In some implementations, the hearing device assembly comprises one or more additional components configured to fit in the main volume within the ear. The one or more additional components may include at least one of a power supply, a processor, an antenna, a microphone, an inertial sensor, and a biometric sensor. In some implementations, the hearing device assembly comprises an acoustic filter and/or an ingress filter configured to fit in the tube. The acoustic filter can be configured to dampen a resonance in the tube. The ingress filter can be configured to obstruct contaminations, for instance cerumen, from entering the tube.

In some implementations, the hearing device assembly comprises a behind-the-ear component communicatively coupled to another component of the hearing device assembly, for instance a component configured to be worn inside the ear canal and/or another behind-the-ear component. The behind-the-ear component may comprise a receiver and/or a transceiver. The other component may comprise a transmitter and/or a transceiver. To illustrate, the transmitter and/or transceiver of the other component may be configured to be worn inside the ear canal and/or communicatively coupled to the microphone and/or the second microphone and/or one or more additional components. The behind-the-ear component can be configured to be worn behind an ear of the user. The communicative coupling may be wired or wireless. For instance, the communicative coupling can comprise a Bluetooth connection. The behind-the-ear component can comprise a processor configured to receive and process audio signals. For instance, the audio signals may be received via the communicative coupling. In some implementations, the behind-the-ear component includes at least one of a power supply, an antenna, a microphone, an inertial sensor, a biometric sensor, and a communication interface.

In some implementations, the hearing device assembly comprises at least one antenna. The antenna may be configured for wireless communication with another hearing device assembly. The antenna may also be configured for wireless communication with a mobile device.

In some implementations, the housing includes a processor configured to receive and process audio signals. In some implementations, the hearing device assembly further comprises a removal line configured to facilitate removal of the hearing device assembly from the ear canal. In some implementations, at least one of the outer seal, the tube, and the inner seal is configured to be selectively detached from the tube. In some implementations, the hearing device assembly further comprises a push rod. The push rod can be configured to allow insertion of the hearing device assembly into the ear canal. For instance, the push rod can be attachable to the tube and/or insertable into the tube in order to allow insertion of the tube into the ear canal. After insertion, the push rod can be removed from the tube.

FIG. 1 shows an exemplary configuration of a hearing device 102. Hearing device 102 may be implemented by any type of device configured to provide or enhance hearing to a user. For example, hearing device 102 may be implemented by a hearing aid configured to provide an audible signal (e.g., amplified audio content) to a user, a sound processor included in a system configured to apply both acoustic and electrical stimulation representative of audio content to a user, or any other suitable hearing prosthesis. As shown, hearing device 102 includes a processor 104 communicatively coupled to a memory 106, a microphone 108, and an output transducer 110. Hearing device 102 may include additional or alternative components as may serve a particular implementation. The term "hearing device assembly" is used herein to refer collectively to the various components that constitute a hearing device (e.g., hearing device 102).

Microphone 108 may be implemented by any suitable audio detection device and is configured to detect audio content ambient to a user of hearing device 102. Microphone 108 comprises an acoustic transducer configured to generate an electric audio signal from the detected audio content. Microphone 108 may be included in or communicatively coupled to hearing device 102 in any suitable manner.

Output transducer 110 may be implemented by any suitable audio output device, such as a loudspeaker of a hearing device. In some examples, output transducer 110 may be included in a housing configured to be positioned entirely within an ear canal of the user.

Memory 106 may be implemented by any suitable type of storage medium and may be configured to maintain (e.g., store) data generated, accessed, or otherwise used by processor 104. For example, memory 106 may maintain hearing loss compensation data, audio processing data, etc.

Processor 104 may be configured to perform various processing operations, such as receiving and processing audio content output by a receiver. Processor 104 may be implemented by any suitable combination of hardware and software. In the description that follows, any references to operations performed by hearing device 102 may be understood to be performed by processor 104 of hearing device 102.

Figure 2:
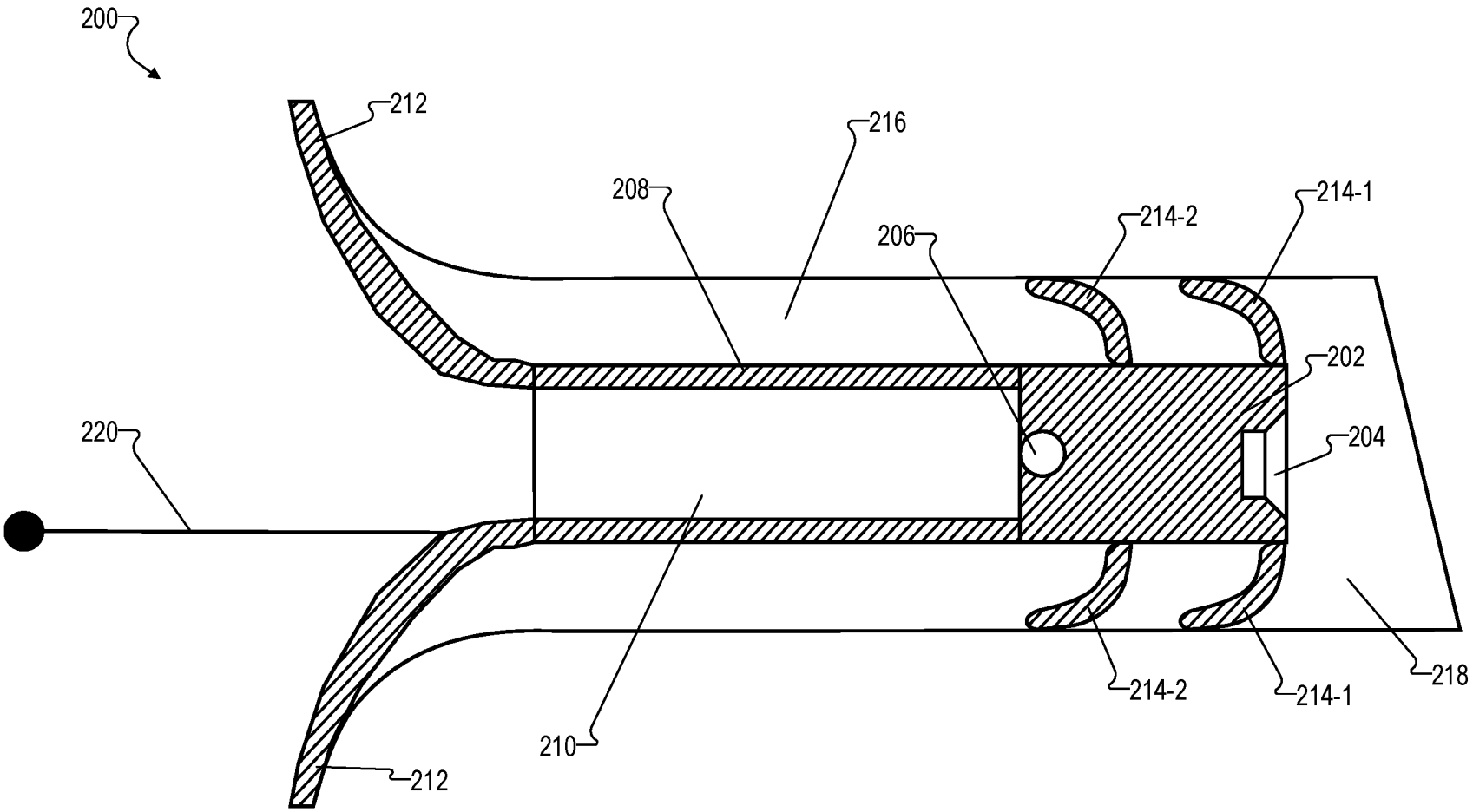
FIGS. 2-12 illustrate exemplary implementations of hearing device assemblies according to principles described herein.

FIG. 2 illustrates a cross-sectional side view of an exemplary hearing device assembly 200 that may implement hearing device 102.

Hearing device assembly 200 includes a housing 202 configured to be positioned in an ear canal of a user. Housing 202 includes a receiver 204 (e.g., an implementation of output transducer 110) and a microphone 206 (e.g., an implementation of microphone 108).

Hearing device assembly 200 further includes a tube 208 extending from a lateral end of housing 202 and configured to provide an acoustic pathway 210 from outside the ear canal to housing 202 (e.g., to microphone 206). Hearing device assembly 200 further includes an outer seal 212 and an inner seal 214 (e.g., inner seal members 214-1 and 214-2). Inner seal 214 and outer seal 212 are together configured to enclose a main volume 216 that radially surrounds tube 208 within the ear canal. Main volume 216 may be configured to be acoustically sealed (e.g., by outer seal 212) from an ambient environment of the user. Inner seal 214 and housing 202 are configured to enclose a residual volume 218 between hearing device assembly 200 and an eardrum of the user.

Hearing device assembly 200 further includes a removal line 220 configured to facilitate removal of hearing device assembly 200 from the user's ear canal. Removal line 220 may be made out of any suitable material.

In some examples, one or more of the components shown in FIG. 2 (as well as other hearing assembly components illustrated in other figures described herein) are optional. For example, in some implementations, hearing device assembly 200 illustrated in FIG. 2 does not include removal line 220 and/or one of inner seal members 214.

Housing 202 is configured to be positioned in the ear canal of the user, relatively close to the eardrum of the user. As housing 202 and inner seal 214 enclose residual volume 218 from such a position relatively close to the eardrum, residual volume 218 may be a relatively small volume (e.g., smaller than those of conventional hearing devices). As receiver 204 is located in housing 202 and consequently positioned close to the eardrum of the user and outputting audio signals through a smaller residual volume 218, receiver 204 may be implemented by a low-power receiver (e.g., a low-power balanced armature receiver or any other suitable receiver). Further, the smaller size of residual volume 218 may provide for improved acoustic coupling between microphone 206 and receiver 204. Mismatches in acoustic coupling may occur due to a length of the ear canal, ear canal volume, and acoustic leakage. With the smaller size of residual volume 218, such variables may be minimized, improving the acoustic coupling for hearing device assembly 200. In addition, an improved reproduction of high frequencies may be achieved by the small size of the residual ear canal volume in comparison to conventional hearing devices where the receiver typically is located much more near the ear canal entrance.

Housing 202 also includes microphone 206, which provides for microphone 206 to be positioned in the ear canal of the user. The positioning of microphone 206 relatively deep into the ear canal (e.g., deeper than in conventional hearing devices, with an inner seal positioned medial to an osseo-cartilaginous junction of the ear canal, etc.) may allow hearing device assembly 200 to provide a more natural sounding audio signal, since the eardrum naturally perceives audio signals after the audio signals travel through the ear canal. Further, positioning microphone 206 deep into the ear canal may enable hearing device assembly 200 to optimize beamforming algorithms, for instance binaural beamforming algorithms, to more accurately represent and/or otherwise focus on sources of audio in the ambient environment.

In some examples, hearing device assembly 200 may be configured such that microphone 206 receives input audio primarily via acoustic pathway 210. Tube 208 (along with outer seal 212) provides acoustic shielding for acoustic pathway 210 to microphone 206 from residual volume 218 and main volume 216. The acoustic shielding of acoustic pathway 210 to microphone 206 may allow hearing device assembly 200 to minimize occlusion effect and provide a high feedback stability threshold. Inner seal 214 may help retain output audio provided by receiver 204 within residual volume 218. Sound that is not retained in residual volume 218 may leak out to main volume 216, which may still be prevented from being picked up by microphone 206 by tube 208 and outer seal 212. Further, main volume 216 combined with tube 208 may also minimize vibration of ear canal walls to transfer a sound of the user's own voice to microphone 206. These features may allow hearing device assembly 200 to minimize occlusion effect and feedback from receiver 204 to microphone 206.

Inner seal 214 may be implemented by one or more inner seal members. Hearing device assembly 200 includes two inner seal members 214-1 and 214-2 (in a cross-section view that shows two parts for each member), which extend radially from housing 202. In some examples, inner seal members 214-1 and 214-2 may be implemented using a soft, comfortable material. Since inner seal 214 may be implemented by more than one member and as outer seal 212 also provides an additional acoustic barrier, the material used for inner seal members 214-1 and 214-2 may consider comfort for the user in the user's ear canal in addition to (or more than) acoustic insulation. Inner seal members 214-1 and/or 214-2 may be configured to be selectively detachable from housing 202 so that inner seal members 214-1 and/or 214-2 may be replaceable and/or adaptable. For example, inner seal members 214-1 and/or 214-2 may be made of a malleable and/or expandable substance that the user may shape to a comfortable fit of hearing device assembly 200 in the ear canal. Additionally or alternatively, a variety of shapes and sizes of inner seal members may be provided from which the user may select one or more members to attach to housing 202 as desired. Additionally or alternatively, inner seal members 214-1 and/or 214-2 may be configured to be custom fit to conform to a shape of the user's ear canal, as described herein.

Outer seal 212 may be implemented by one or more outer seal members. Hearing device assembly 200 includes one outer seal member (the cross-sectional side view of FIG. 2 shows two parts of the one member) extending from a lateral end of tube 208. Outer seal 212 includes an opening in the middle that provides acoustic pathway 210 from outside the ear canal through tube 208 to housing 202. Though FIG. 2 shows a line to demarcate outer seal 212 from tube 208, acoustic pathway 210 may be configured to be hollow throughout a length of acoustic pathway 210. Outer seal 212 may also serve as a catch to prevent hearing device assembly 200 from being pushed too far into the ear canal of the user. Further, outer seal 212 may also serve to help keep hearing device assembly 200 in place.

Outer seal 212 may provide an acoustic seal by being formed to closely fit in an entrance of the ear canal (e.g., a concha of the user). In some examples, outer seal 212 may be formed to closely fit the entrance of the ear canal by custom fitting outer seal 212 to the user's ear canal entrance and/or concha. Such custom fitting may be implemented in any suitable manner. For example, outer seal 212 may be thermo-formed and/or 3D-printed based on an impression of the ear canal entrance and/or concha (e.g., using 3D scanning, a mold, etc.). In other examples, outer seal 212 is not custom fit to the user's ear canal entrance and/or concha.

In some examples, outer seal 212 may be selectively detachable from tube 208, which may allow the user to custom fit outer seal 212 to the user's concha. For instance, the outer seal 212 may be implemented using a material that may soften (e.g., by heating the material) so that it may be molded and conformed to a shape of the user's concha and then allowed to harden to retain the custom-fit shape. Outer seal 212 may then be reattached to tube 208 to provide acoustic sealing for main volume 216 and function as an opening for acoustic pathway 210. Additionally or alternatively, hearing device assembly 200 may be provided with a variety of sizes and shapes for outer seal 212 so that the user may select one that fits best to attach to tube 208.

Outer seal 212 may also include one or more mechanisms to equalize pressure between main volume 216 and the ambient environment. These mechanisms may be implemented in any suitable manner. For example, outer seal 212 may include one or more small perforations or may be configured to intentionally leak in a controlled manner.

Tube 208 extends from the lateral end of housing 202 and provides acoustic pathway 210, connecting to outer seal 212. Tube 208 may be implemented in any suitable manner. For instance, tube 208 may be manufactured of a thin, elastic material (e.g. a polymeric, biocompatible material such as silicon rubber) so that tube 208 may conform to a shape of the user's ear canal. Additionally or alternatively, tube 208 may be configured to be custom fit, similar to outer seal 212, to fit a size, length, and/or shape of the user's ear canal. In some examples, tube 208 may be made of a same material as outer seal 212 and custom fit in a same or similar manner. The tube material and geometry may be chosen such that the tube provides sufficient mechanical stability against buckling when inserting the housing 202 into the ear canal.

In some examples, tube 208 may be configured to be selectively detachable from housing 202 so that tube 208 may be custom fit and/or replaceable. Alternatively, tube 208 may be integrated into housing 202 and therefore not selectively detachable from housing 202.

While FIG. 2 shows housing 202 including receiver 204 and microphone 206, in some examples, receiver 204 and/or microphone 206 may be included in a different portion of hearing device assembly 200 and/or separate from hearing device assembly 200. Additionally or alternatively, any other suitable components of hearing device assembly 200 may also be included in housing 202, such as a processor (e.g., processor 104), a memory (e.g., memory 106), a power source (e.g., a battery), a signal processing unit, one or more sensors (e.g., an accelerometer, a biometric sensor, etc.), a communication component, etc.

Figure 3:
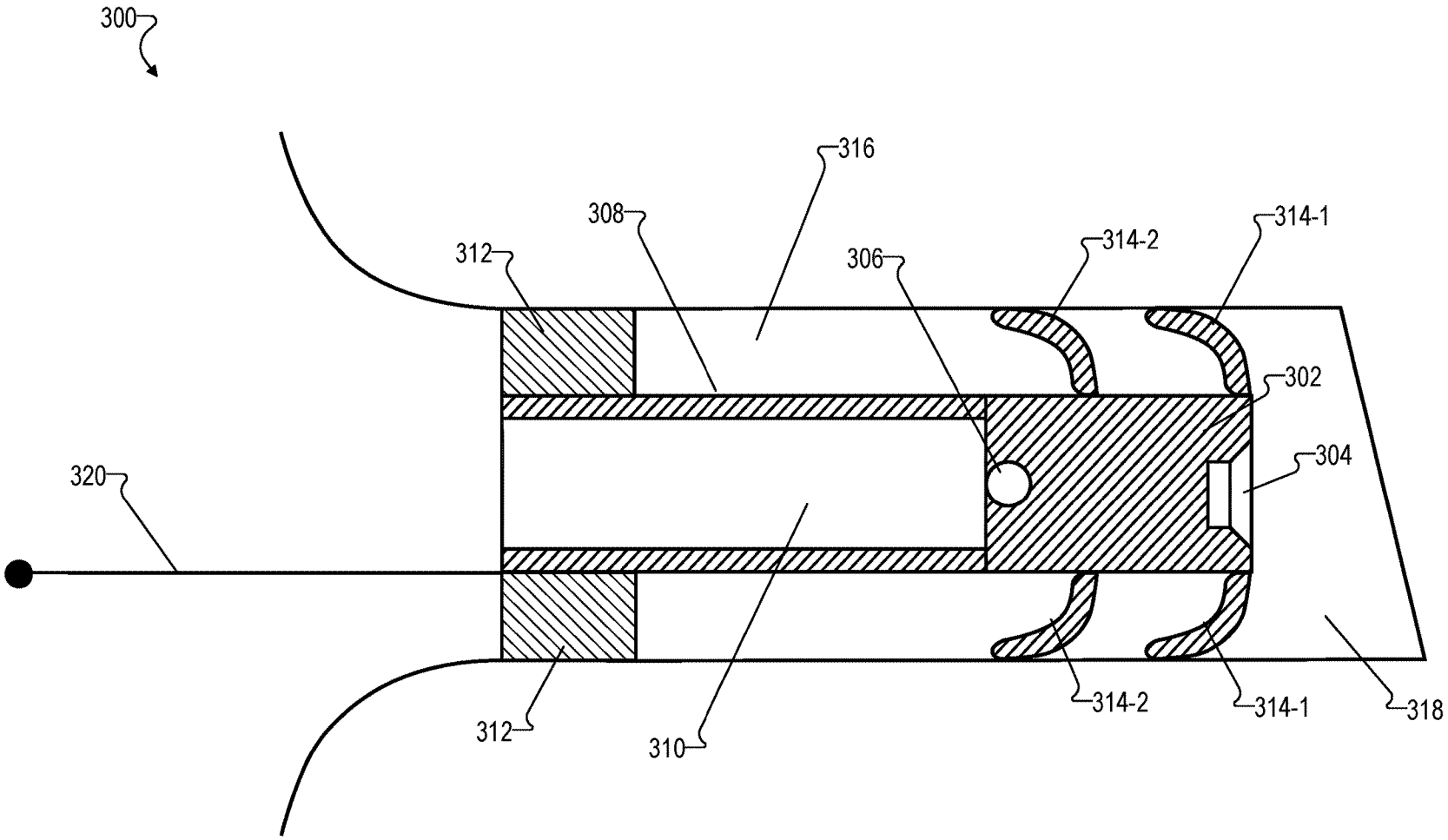

FIG. 3 illustrates a cross-sectional side view of another exemplary hearing device assembly 300 that may implement hearing device 102. Similar to hearing device assembly 200, hearing device assembly 300 includes a housing 302 configured to be positioned in an ear canal of a user. Housing 302 includes a receiver 304 (e.g., an implementation of output transducer 110) and a microphone 306 (e.g., an implementation of microphone 108). Hearing device assembly 300 includes a tube 308 extending from a lateral end of housing 302 and configured to provide an acoustic pathway 310 from outside the ear canal to housing 302 (e.g., to microphone 306). Hearing device assembly 300 also includes an outer seal 312 and an inner seal 314 (e.g., inner seal members 314-1 and 314-2). Inner seal 314 and outer seal 312 are together configured to enclose a main volume 316 that radially surrounds tube 308 within the ear canal. Main volume 316 may be configured to be acoustically sealed (e.g., by outer seal 312) from an ambient environment of the user. Inner seal 314 and housing 302 are configured to enclose a residual volume 318 between hearing device assembly 300 and an eardrum of the user. Hearing device assembly 300 also includes a removal line 320 configured to facilitate removal of hearing device assembly 300 from the user's ear canal.

Outer seal 312 in hearing device assembly 300 extends radially from a lateral end of tube 308 but is configured to be positioned within the ear canal of the user, rather than extending out of the ear canal as with outer seal 212 in hearing device assembly 200. Otherwise outer seal 312 serves many of the same functions as outer seal 212, providing an acoustic seal for main volume 316 from the ambient environment of the user and from acoustic pathway 310. Outer seal 312 may be configured to be removably detached from tube 308 and configured to be custom fit to a shape of the user's ear canal, as described herein.

Figure 4:
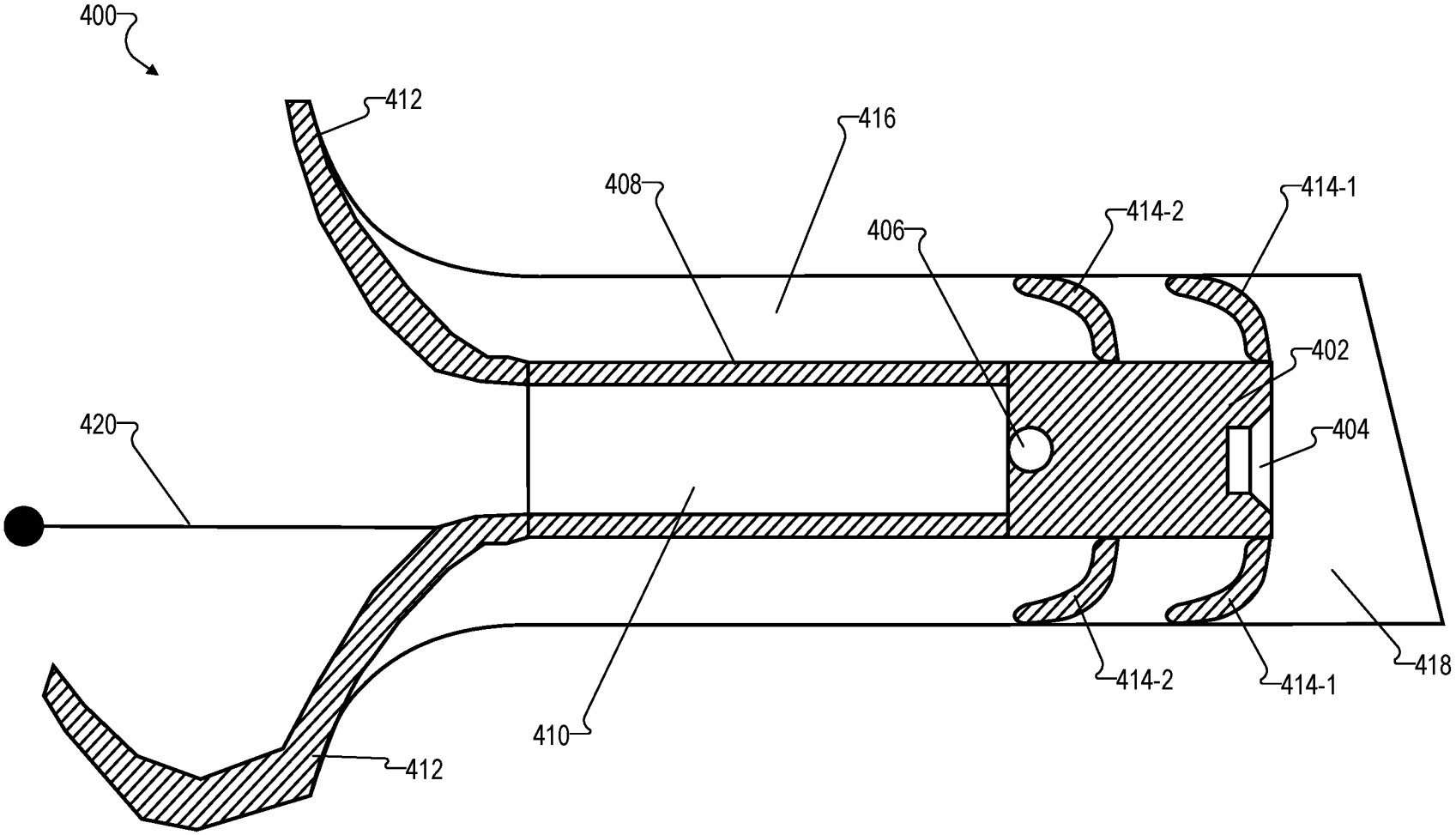

FIG. 4 illustrates a cross-sectional side view of another exemplary hearing device assembly 400 that may implement hearing device 102. Similar to hearing device assembly 200, hearing device assembly 400 includes a housing 402 configured to be positioned in an ear canal of a user. Housing 402 includes a receiver 404 (e.g., an implementation of output transducer 110) and a microphone 406 (e.g., an implementation of microphone 108). Hearing device assembly 400 includes a tube 408 extending from a lateral end of housing 402 and configured to provide an acoustic pathway 410 from outside the ear canal to housing 402 (e.g., to microphone 406). Hearing device assembly 400 also includes an outer seal 412 and an inner seal 414 (e.g., inner seal members 414-1 and 414-2). Inner seal 414 and outer seal 412 are together configured to enclose a main volume 416 that radially surrounds tube 408 within the ear canal. Main volume 416 may be configured to be acoustically sealed (e.g., by outer seal 412) from an ambient environment of the user. Inner seal 414 and housing 402 are configured to enclose a residual volume 418 between hearing device assembly 400 and an eardrum of the user. Hearing device assembly 400 also includes a removal line 420 configured to facilitate removal of hearing device assembly 400 from the user's ear canal.

Outer seal 412 in hearing device assembly 400 extends further into a concha of the user than outer seal 212 of hearing device assembly 200, as shown with an extended lower portion of outer seal 412. As described above with outer seal 212, outer seal 412 (including the extended portion) may be configured to be custom fit to conform to a shape of the concha of the user. The extended portion of outer seal 412 may provide additional retention of hearing device assembly 400 and/or additional acoustic insulation. The extended portion may also provide a space for placement of components of hearing device assembly 400 and/or hearing device 102, such as shown in FIG. 5.

Figure 5:
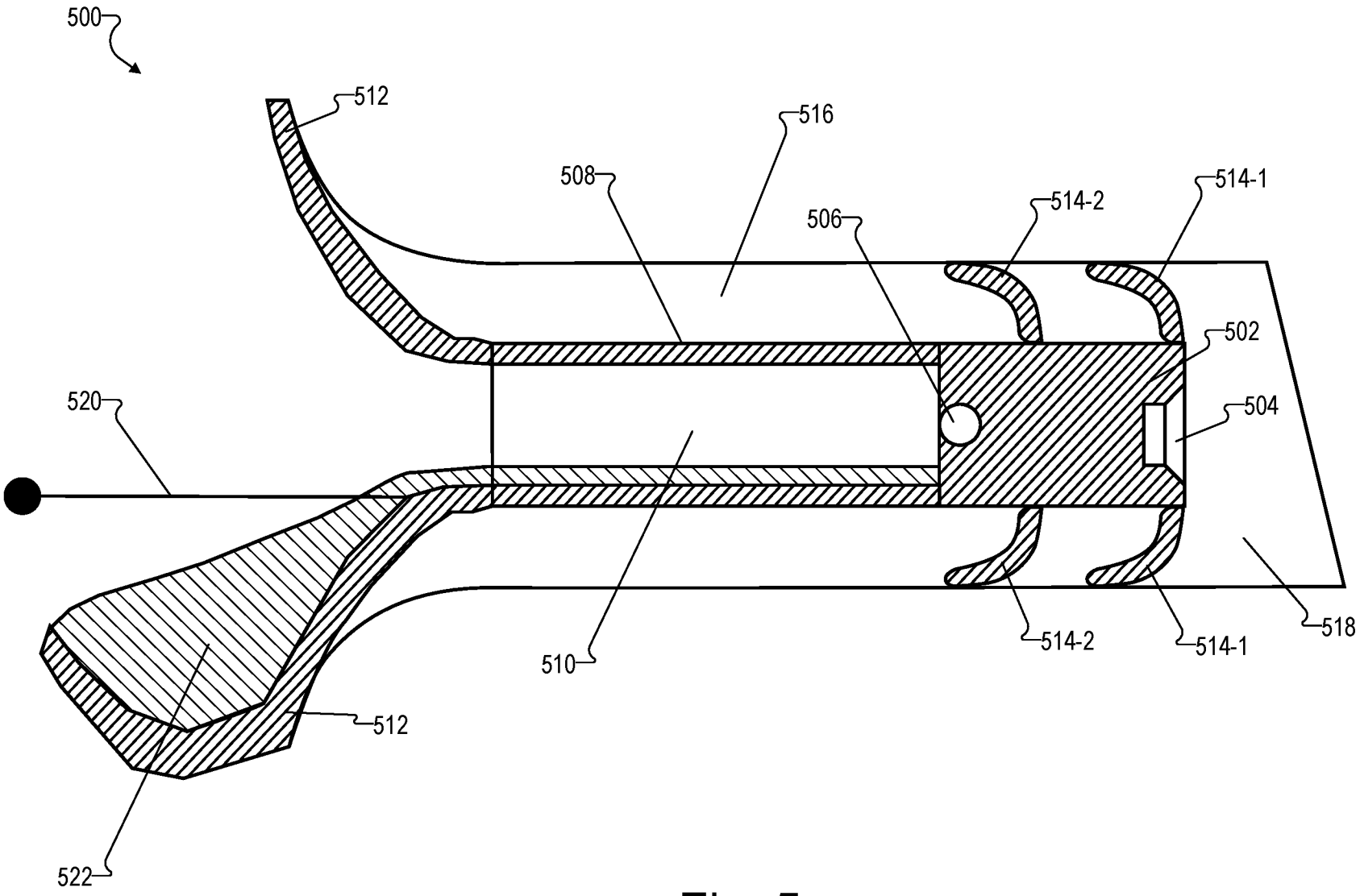

FIG. 5 illustrates a cross-sectional side view of another exemplary hearing device assembly 500 that may implement hearing device 102. Similar to hearing device assembly 400, hearing device assembly 500 includes a housing 502 configured to be positioned in an ear canal of a user. Housing 502 includes a receiver 504 (e.g., an implementation of output transducer 110) and a microphone 506 (e.g., an implementation of microphone 108). Hearing device assembly 500 includes a tube 508 extending from a lateral end of housing 502 and configured to provide an acoustic pathway 510 from outside the ear canal to housing 502 (e.g., to microphone 506). Hearing device assembly 500 also includes an outer seal 512 and an inner seal 514 (e.g., inner seal members 514-1 and 514-2). Inner seal 514 and outer seal 512 are together configured to enclose a main volume 516 that radially surrounds tube 508 within the ear canal. Main volume 516 may be configured to be acoustically sealed (e.g., by outer seal 512) from an ambient environment of the user. Inner seal 514 and housing 502 are configured to enclose a residual volume 518 between hearing device assembly 500 and an eardrum of the user. Hearing device assembly 500 also includes a removal line 520 configured to facilitate removal of hearing device assembly 500 from the user's ear canal.

Hearing device assembly 500 further includes an additional housing 522 in an extended portion of outer seal 512. Additional housing 522 may be configured to house additional components of hearing device assembly 500. Such additional components may include, but are not limited to, a processor (e.g., processor 104), a memory (e.g., memory 106), a power source (e.g., a battery), a signal processing unit, one or more sensors (e.g., an accelerometer, a biometric sensor, etc.), a communication component, an antenna, etc. The additional components may be communicatively coupled to components in housing 502 in any suitable manner (e.g., by way of one or more wired and/or wireless interfaces).

Figure 6:
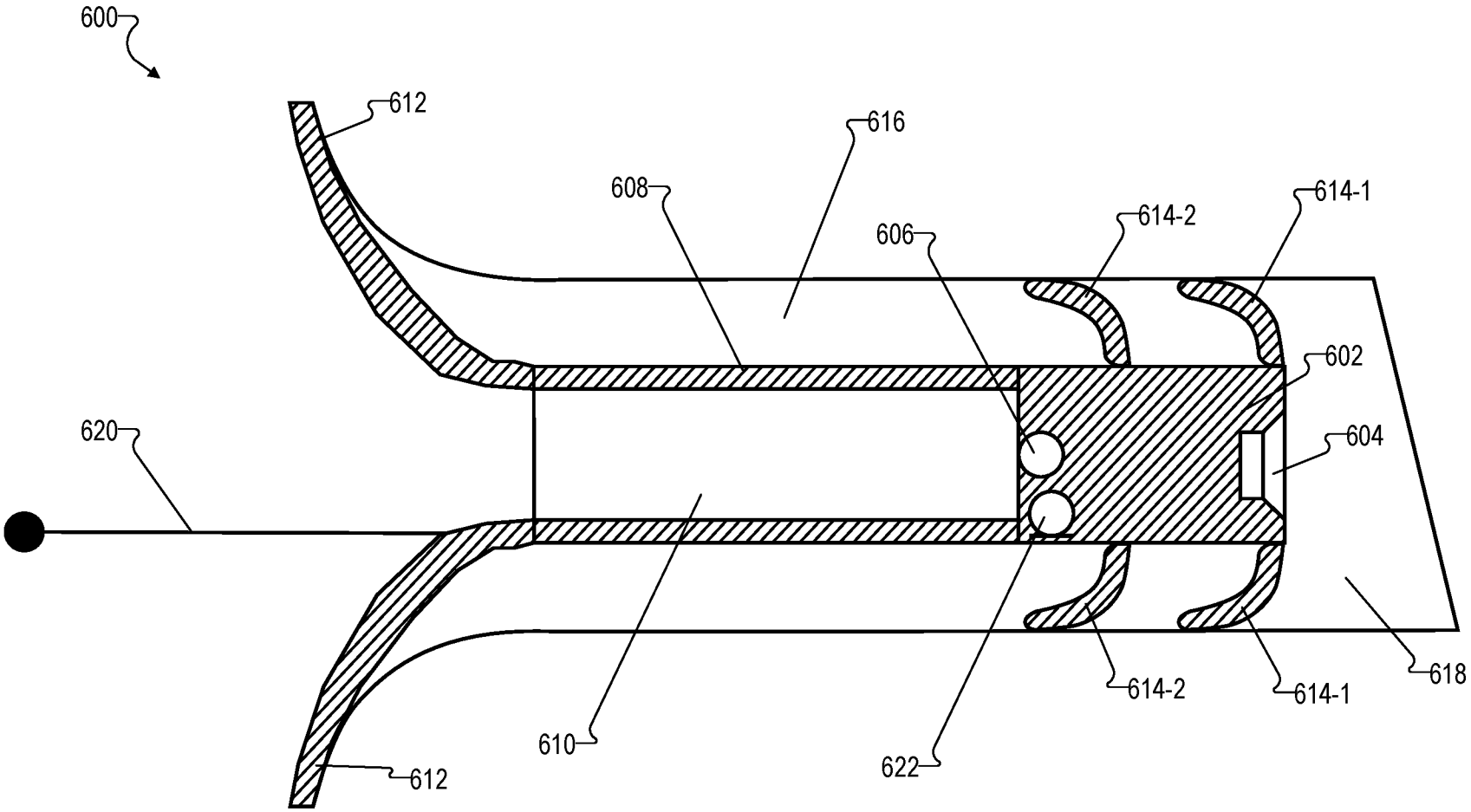

FIG. 6 illustrates a cross-sectional side view of another exemplary hearing device assembly 600 that may implement hearing device 102. Similar to hearing device assembly 200, hearing device assembly 600 includes a housing 602 configured to be positioned in an ear canal of a user. Housing 602 includes a receiver 604 (e.g., an implementation of output transducer 110) and a microphone 606 (e.g., an implementation of microphone 108). Hearing device assembly 600 includes a tube 608 extending from a lateral end of housing 602 and configured to provide an acoustic pathway 610 from outside the ear canal to housing 602 (e.g., to microphone 606). Hearing device assembly 600 also includes an outer seal 612 and an inner seal 614 (e.g., inner seal members 614-1 and 614-2). Inner seal 614 and outer seal 612 are together configured to enclose a main volume 616 that radially surrounds tube 608 within the ear canal. Main volume 616 may be configured to be acoustically sealed (e.g., by outer seal 612) from an ambient environment of the user. Inner seal 614 and housing 602 are configured to enclose a residual volume 618 between hearing device assembly 600 and an eardrum of the user. Hearing device assembly 600 also includes a removal line 620 configured to facilitate removal of hearing device assembly 600 from the user's ear canal.

In addition, hearing device assembly 600 includes a canal microphone 622, which may be configured to receive input audio of the user's own voice. Receiver 604 may provide the own-voice audio for any suitable application. For example, when the user is speaking on a phone, the user may expect to hear the own-voice audio, which may then be provided by receiver 604. Canal microphone 622 may be oriented (e.g., in contact with and/or facing a wall of housing 602) such that it can pick up audio and/or vibrations from the canal.

Figure 7:
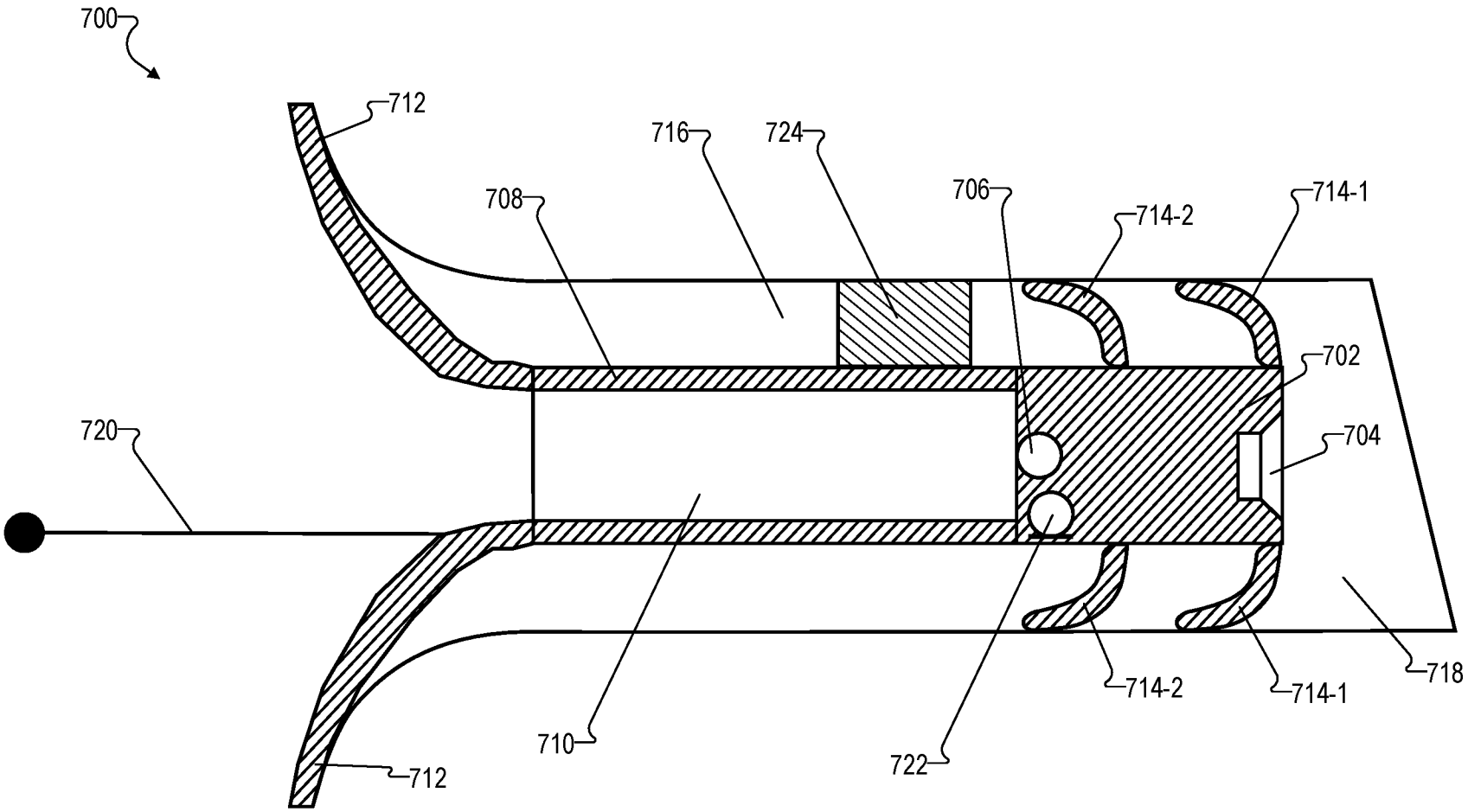

FIG. 7 illustrates a cross-sectional side view of another exemplary hearing device assembly 700 that may implement hearing device 102. Similar to hearing device assembly 600, hearing device assembly 700 includes a housing 702 configured to be positioned in an ear canal of a user. Housing 702 includes a receiver 704 (e.g., an implementation of output transducer 110) and a microphone 706 (e.g., an implementation of microphone 108). Hearing device assembly 700 includes a tube 708 extending from a lateral end of housing 702 and configured to provide an acoustic pathway 710 from outside the ear canal to housing 702 (e.g., to microphone 706). Hearing device assembly 700 also includes an outer seal 712 and an inner seal 714 (e.g., inner seal members 714-1 and 714-2). Inner seal 714 and outer seal 712 are together configured to enclose a main volume 716 that radially surrounds tube 708 within the ear canal. Main volume 716 may be configured to be acoustically sealed (e.g., by outer seal 712) from an ambient environment of the user. Inner seal 714 and housing 702 are configured to enclose a residual volume 718 between hearing device assembly 700 and an eardrum of the user. Hearing device assembly 700 also includes a removal line 720 configured to facilitate removal of hearing device assembly 700 from the user's ear canal. Hearing device assembly 700 also includes a canal microphone 722 configured to receive input audio of the user's own voice.

In addition, hearing device assembly 700 includes an additional housing 724 extending from tube 708 into main volume 716. Additional housing 724 may be configured to house additional components of hearing device assembly 700. Such additional components may include, but are not limited to, a processor (e.g., processor 104), a memory (e.g., memory 106), a power source (e.g., a battery), a signal processing unit, one or more sensors (e.g., an accelerometer, a biometric sensor, etc.), a communication component, an antenna, etc. The additional components may be communicatively coupled to components in housing 702 in any suitable manner (e.g., by way of one or more wired and/or wireless interfaces). For example, additional housing 724 may include a biometric sensor that may be configured to operate with skin contact or near-skin contact such as a heart rate sensor, an oxygenation sensor, a blood pressure sensor, or any other such sensor. Additional housing 724 may also include a vibration sensor and/or an additional microphone that may facilitate receiving input audio of the user's own voice. The vibration sensor and/or the additional microphone may receive the own-voice audio in addition to and/or instead of canal microphone 722.

Figure 8:
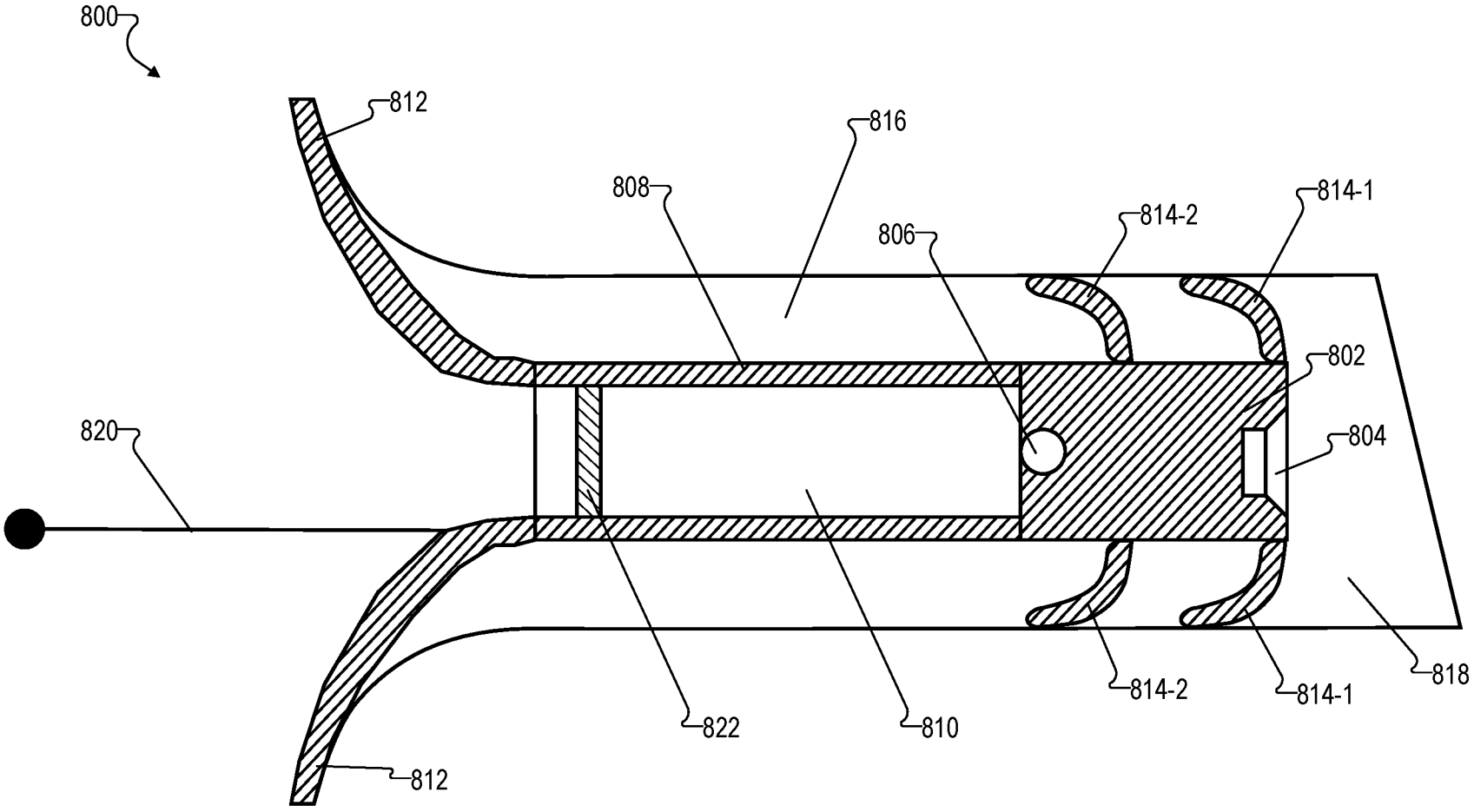

FIG. 8 illustrates a cross-sectional side view of another exemplary hearing device assembly 800 that may implement hearing device 102. Similar to hearing device assembly 200, hearing device assembly 800 includes a housing 802 configured to be positioned in an ear canal of a user. Housing 802 includes a receiver 804 (e.g., an implementation of output transducer 110) and a microphone 806 (e.g., an implementation of microphone 108). Hearing device assembly 800 includes a tube 808 extending from a lateral end of housing 802 and configured to provide an acoustic pathway 810 from outside the ear canal to housing 802 (e.g., to microphone 806). Hearing device assembly 800 also includes an outer seal 812 and an inner seal 814 (e.g., inner seal members 814-1 and 814-2). Inner seal 814 and outer seal 812 are together configured to enclose a main volume 816 that radially surrounds tube 808 within the ear canal. Main volume 816 may be configured to be acoustically sealed (e.g., by outer seal 812) from an ambient environment of the user. Inner seal 814 and housing 802 are configured to enclose a residual volume 818 between hearing device assembly 800 and an eardrum of the user. Hearing device assembly 800 also includes a removal line 820 configured to facilitate removal of hearing device assembly 800 from the user's ear canal.

In addition, hearing device assembly 800 includes a filter 822 in acoustic pathway 810. Filter 822 may be implemented by any suitable filter. For example, filter 822 may be any suitable acoustic filter, such as a microphone filter configured to dampen a quarter-wavelength resonance of tube 808. Filter 822 may also serve to provide protection to microphone 806. For instance, filter 822 may protect microphone 806 from water, wax, and/or other ingress. Such protection may be provided by any suitable acoustic filter and/or any suitable mesh or surface that is at least partially acoustically permeable. While hearing device assembly 800 shows one filter 822, a plurality of filters may be used. The plurality of filters may be of one or many different types of filters. The filters may be configured to be selectively detachable from tube 808.

Figure 9:
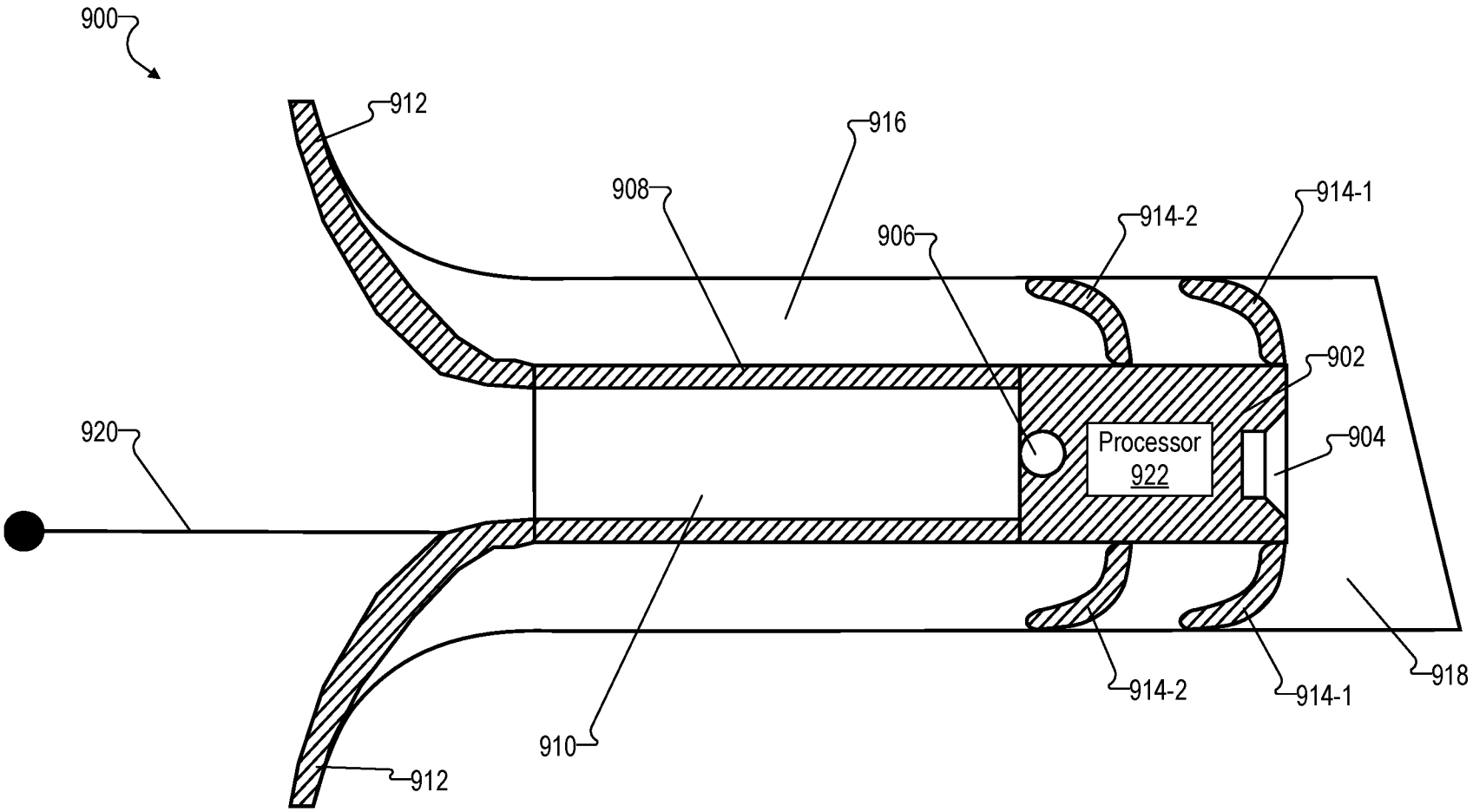

FIG. 9 illustrates a cross-sectional side view of another exemplary hearing device assembly 900 that may implement hearing device 102. Similar to hearing device assembly 200, hearing device assembly 900 includes a housing 902 configured to be positioned in an ear canal of a user. Housing 902 includes a receiver 904 (e.g., an implementation of output transducer 110) and a microphone 906 (e.g., an implementation of microphone 108). Hearing device assembly 900 includes a tube 908 extending from a lateral end of housing 902 and configured to provide an acoustic pathway 910 from outside the ear canal to housing 902 (e.g., to microphone 906). Hearing device assembly 900 also includes an outer seal 912 and an inner seal 914 (e.g., inner seal members 914-1 and 914-2). Inner seal 914 and outer seal 912 are together configured to enclose a main volume 916 that radially surrounds tube 908 within the ear canal. Main volume 916 may be configured to be acoustically sealed (e.g., by outer seal 912) from an ambient environment of the user. Inner seal 914 and housing 902 are configured to enclose a residual volume 918 between hearing device assembly 900 and an eardrum of the user. Hearing device assembly 900 also includes a removal line 920 configured to facilitate removal of hearing device assembly 900 from the user's ear canal. Hearing device assembly 900 further includes a processor 922 (e.g., an implementation of processor 104) included in housing 902.

Figure 10:
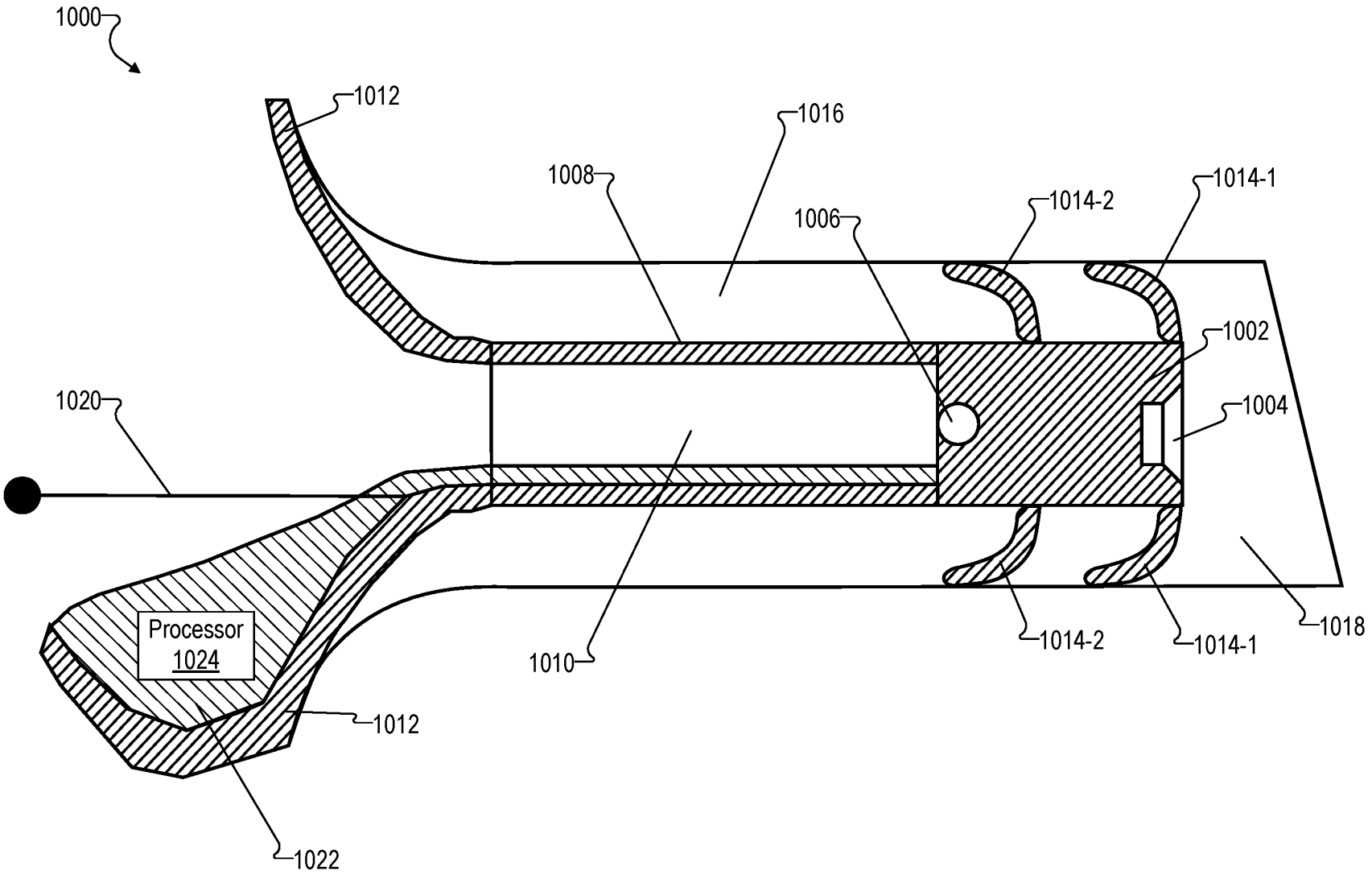

FIG. 10 illustrates a cross-sectional side view of another exemplary hearing device assembly 1000 that may implement hearing device 102. Similar to hearing device assembly 200, hearing device assembly 1000 includes a housing 1002 configured to be positioned in an ear canal of a user. Housing 1002 includes a receiver 1004 (e.g., an implementation of output transducer 110) and a microphone 1006 (e.g., an implementation of microphone 108). Hearing device assembly 1000 includes a tube 1008 extending from a lateral end of housing 1002 and configured to provide an acoustic pathway 1010 from outside the ear canal to housing 1002 (e.g., to microphone 1006). Hearing device assembly 1000 also includes an outer seal 1012 and an inner seal 1014 (e.g., inner seal members 1014-1 and 1014-2). Inner seal 1014 and outer seal 1012 are together configured to enclose a main volume 1016 that radially surrounds tube 1008 within the ear canal. Main volume 1016 may be configured to be acoustically sealed (e.g., by outer seal 1012) from an ambient environment of the user. Inner seal 1014 and housing 1002 are configured to enclose a residual volume 1018 between hearing device assembly 1000 and an eardrum of the user. Hearing device assembly 1000 also includes a removal line 1020 configured to facilitate removal of hearing device assembly 1000 from the user's ear canal. Hearing device assembly 1000 further includes an additional housing 1022 located in an extended portion of outer seal 1012. Additional housing 1022 includes a processor 1024 (e.g., an implementation of processor 104). Processor 1024 may be communicatively coupled to receiver 1004, microphone 1006, and/or any other suitable components housed in housing 1002.

Figure 11:
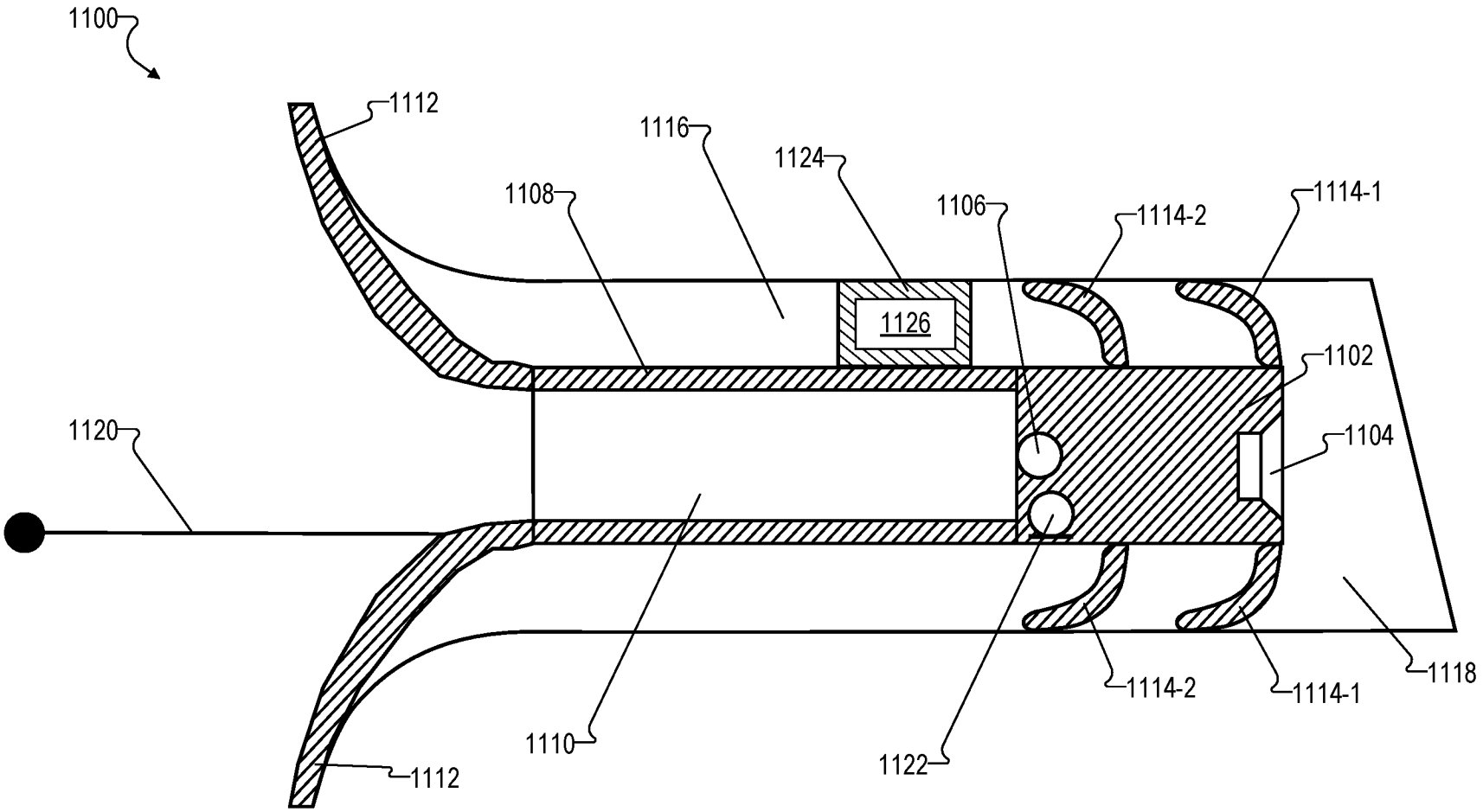

FIG. 11 illustrates a cross-sectional side view of another exemplary hearing device assembly 1100 that may implement hearing device 102. Similar to hearing device assembly 200, hearing device assembly 1100 includes a housing 1102 configured to be positioned in an ear canal of a user. Housing 1102 includes a receiver 1104 (e.g., an implementation of output transducer 110) and a microphone 1106 (e.g., an implementation of microphone 108). Hearing device assembly 1100 includes a tube 1108 extending from a lateral end of housing 1102 and configured to provide an acoustic pathway 1110 from outside the ear canal to housing 1102 (e.g., to microphone 1106). Hearing device assembly 1100 also includes an outer seal 1112 and an inner seal 1114 (e.g., inner seal members 1114-1 and 1114-2). Inner seal 1114 and outer seal 1112 are together configured to enclose a main volume 1116 that radially surrounds tube 1108 within the ear canal. Main volume 1116 may be configured to be acoustically sealed (e.g., by outer seal 1112) from an ambient environment of the user. Inner seal 1114 and housing 1102 are configured to enclose a residual volume 1118 between hearing device assembly 1100 and an eardrum of the user. Hearing device assembly 1100 also includes a removal line 1120 configured to facilitate removal of hearing device assembly 1100 from the user's ear canal. Hearing device assembly 1100 further includes a canal microphone 1122 configured to receive input audio of the user's own voice. Hearing device assembly 1100 further includes an additional housing 1124 located in main volume 1116. Additional housing 1124 includes a processor 1126 (e.g., an implementation of processor 104). Processor 1126 may be communicatively coupled to receiver 1104, microphone 1106, canal microphone 1122, and/or any other suitable components housed in housing 1102.

Figure 12:
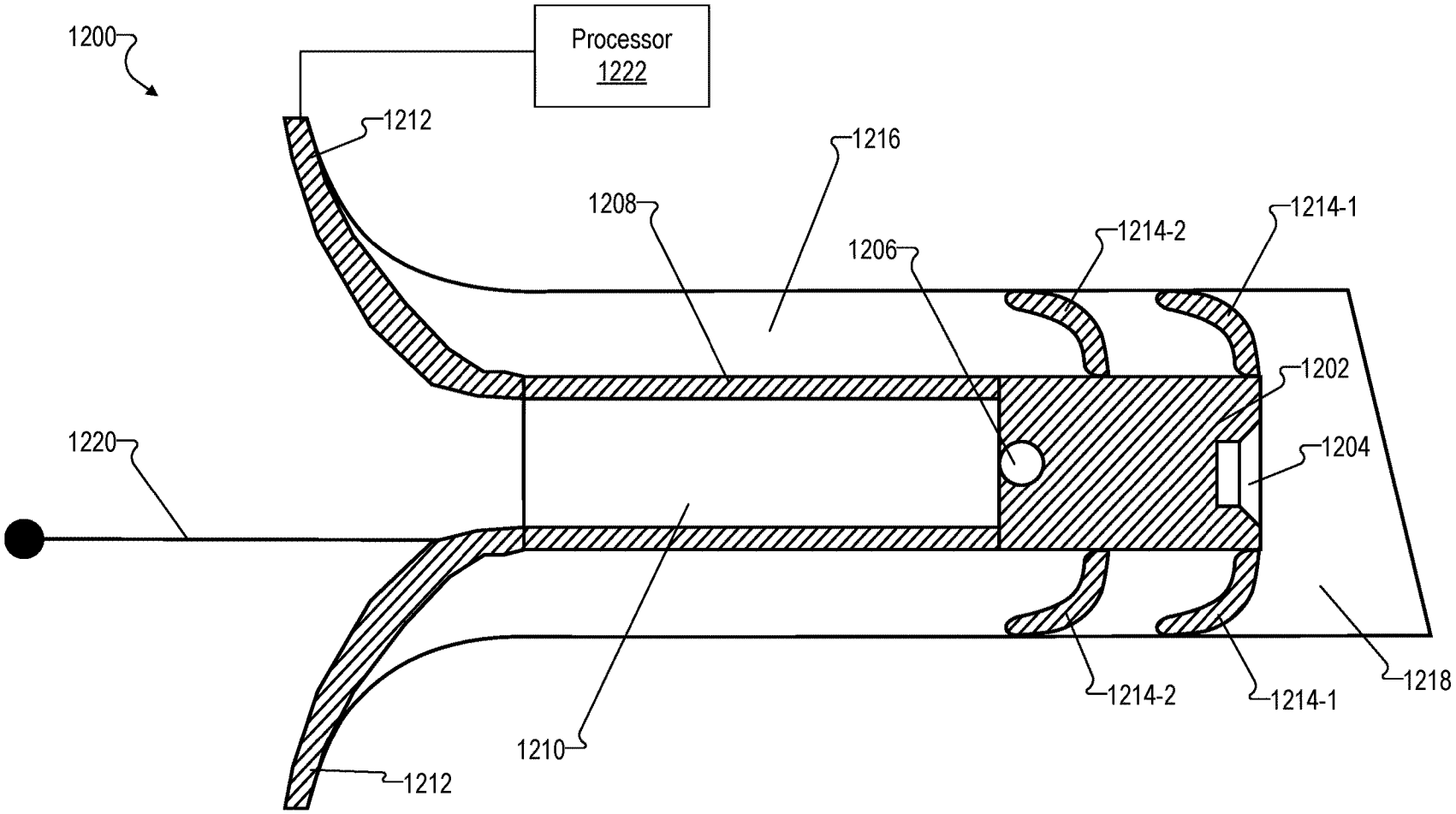

FIG. 12 illustrates a cross-sectional side view of another exemplary hearing device assembly 1200 that may implement hearing device 102. Similar to hearing device assembly 200, hearing device assembly 1200 includes a housing 1202 configured to be positioned in an ear canal of a user. Housing 1202 includes a receiver 1204 (e.g., an implementation of output transducer 110) and a microphone 1206 (e.g., an implementation of microphone 108). Hearing device assembly 1200 includes a tube 1208 extending from a lateral end of housing 1202 and configured to provide an acoustic pathway 1210 from outside the ear canal to housing 1202 (e.g., to microphone 1206). Hearing device assembly 1200 also includes an outer seal 1212 and an inner seal 1214 (e.g., inner seal members 1214-1 and 1214-2). Inner seal 1214 and outer seal 1212 are together configured to enclose a main volume 1216 that radially surrounds tube 1208 within the ear canal. Main volume 1216 may be configured to be acoustically sealed (e.g., by outer seal 1212) from an ambient environment of the user. Inner seal 1214 and housing 1202 are configured to enclose a residual volume 1218 between hearing device assembly 1200 and an eardrum of the user. Hearing device assembly 1200 also includes a removal line 1220 configured to facilitate removal of hearing device assembly 1200 from the user's ear canal. Hearing device assembly 1200 further includes a processor 1222 (e.g., an implementation of processor 104) external to a main portion of hearing device assembly 1200. Processor 1222 may be included in an additional assembly, such as a behind-the-ear assembly, and/or another device such as a smartphone, a smartwatch, smart glasses, etc. Processor 1222 may be communicatively coupled (e.g., using a wired connection and/or a wireless connection) to a receiver 1204, a microphone 1206, an additional processor, and/or any other suitable components housed in housing 1202.

In some examples, the hearing device assembly may include multiple additional housings, such as in an extended portion of an outer seal and in a main volume. In such examples, any suitable components may be included in any of the housings. In other examples, components may be included in such additional locations independent of a housing, such as a biometric sensor configured to contact an inner wall of an ear canal of the user in the main volume.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing device assembly configured to be worn at least partially within an ear canal of a user, the hearing device assembly comprising:

a housing including an output transducer configured to provide an output audio signal representative of sound presented to the user, the housing configured to be positioned entirely within the ear canal;

a tube extending from an end of the housing and configured to provide an acoustic pathway from outside the ear canal to the housing;

an inner seal extending from the housing; and an outer seal extending from the tube;

wherein the inner seal and the outer seal are together configured to enclose a main volume that surrounds the tube within the ear canal and that is acoustically sealed from an ambient environment of the user.

2. The hearing device assembly of claim 1, wherein the inner seal is configured to create a residual ear canal volume between an ear drum of the user and a surface formed by the inner seal and the housing.

3. The hearing device assembly of claim 1, wherein the inner seal is implemented by one or more retention rings that extend radially from the housing to a wall of the ear canal.

4. The hearing device assembly of claim 1, wherein:

the housing further includes a microphone configured to detect an input audio signal; and the output audio signal is based on the input audio signal.

5. The hearing device assembly of claim 4, wherein the housing further includes a second microphone configured to detect a voice of the user.

6. The hearing device assembly of claim 1, wherein the outer seal is implemented by one or more retention rings that extend radially from a lateral end of the tube to a wall of the ear canal.

7. The hearing device assembly of claim 1, wherein the outer seal is implemented by one or more retention members that extend out of the ear canal and into a concha of the user, the one or more retention members configured to fit in the concha of the user.

8. The hearing device assembly of claim 7, wherein the one or more retention members are configured to fit in the concha of the user by being individually fitted to a shape of the concha.

9. The hearing device assembly of claim 8, wherein the tube is individually fitted to at least one of a shape and a length of the ear canal.

10. The hearing device assembly of claim 7, wherein the outer seal is configured to hold one or more additional components of the hearing device assembly.

11. The hearing device assembly of claim 10, wherein the one or more additional components include at least one of a power supply, a processor, a communication interface, an inertial sensor, a biometric sensor, and an antenna.

12. The hearing device assembly of claim 1, further comprising one or more additional components of the hearing device assembly configured to fit in the main volume within the ear canal.

13. The hearing device assembly of claim 12, wherein the one or more additional components include at least one of a power supply, a processor, an antenna, a microphone, an inertial sensor, and a biometric sensor.

14. The hearing device assembly of claim 1, further comprising at least one of an acoustic filter and an ingress filter configured to fit in the tube.

15. The hearing device assembly of claim 1, further comprising a behind-the-ear component communicatively coupled to another component of the hearing device assembly.

16. The hearing device assembly of claim 15, wherein the behind-the-ear component comprises a processor configured to receive and process audio signals.

17. The hearing device assembly of claim 15, wherein the behind-the-ear component includes at least one of a power supply, an antenna, a microphone, an inertial sensor, a biometric sensor, and a communication interface.

18. The hearing device assembly of claim 1, wherein the housing includes a processor configured to receive and process audio signals.

19. The hearing device assembly of claim 1, further comprising a removal line configured to facilitate removal of the hearing device assembly from the ear canal.

20. The hearing device assembly of claim 1, wherein at least one of the outer seal, the tube, and the inner seal is configured to be selectively detached from the tube.

* * * * *